US005571030A

United States Patent [19]

Gladd et al.

[11] Patent Number: 5,571,030

[45] Date of Patent: Nov. 5, 1996

[54] PROTECTED CONNECTOR ASSEMBLY HAVING DOUBLE ENDED SHORTING CLIP

[75] Inventors: Joseph H. Gladd; John M. Sova, both of Cortland; Paul S. Ghirardi, Brookfield, all of Ohio

[73] Assignee: General Motors Corporation, Detroit, Mich.

[21] Appl. No.: 369,947

[22] Filed: Jan. 9, 1995

[51] Int. Cl.[6] ..... H01R 9/00

[52] U.S. Cl. ..... 439/489; 439/188

[58] Field of Search ..... 439/188, 507, 439/511, 513, 489, 488, 350, 351, 352, 135, 136; 200/51.1

[56] References Cited

U.S. PATENT DOCUMENTS

| | | | |
|---|---|---|---|
| 3,869,191 | 3/1975 | Tolnar, Jr. et al. . | |
| 4,448,477 | 5/1984 | Gladd et al. . | |
| 4,906,203 | 3/1990 | Margrave et al. | 439/188 |
| 4,978,311 | 12/1990 | Oda et al. | 439/188 |
| 5,263,872 | 11/1993 | Marpoe, Jr. et al. | 439/188 |
| 5,338,211 | 8/1994 | Kodama et al. | 439/490 |
| 5,370,543 | 12/1994 | Hamada et al. | 439/352 |

*Primary Examiner*—Hien D. Vu
*Attorney, Agent, or Firm*—Cary W. Brooks

[57] ABSTRACT

An electrical connector assembly has a pair of mating connector housings carrying mating metal terminals, a double ended shorting clip carried by one of the housings and having both ends thereof in spring biased engagement with its associated metal terminals in that housing, a third housing encircling the housings and a tethered connector position assurance member connected to the third housing. The shorting clip first has one end automatically disengaged from its associated metal terminals by a first cam when the connector housings are mated together and then its other end automatically disengaged from its associated terminals by a second cam on the connector position assurance member when it is connected to the third housing so that a shorting path across the associated metal terminals is only fully disconnected if proper mating of the connector housings is assured. The third housing provides environmental splash protection, strain relief for conductors connected to the terminals and has an integral terminal position assurance means for assuring proper positioning of the terminals in the housing. The third housing also has a depressible dome to release the connector housings from each other.

22 Claims, 7 Drawing Sheets

PROTECTED CONNECTOR ASSEMBLY HAVING DOUBLE ENDED SHORTING CLIP

FIELD OF THE INVENTION

This invention relates to electrical connectors.

BACKGROUND OF THE INVENTION

The present invention relates to an electrical connector assembly having a shorting clip, and, in particular, to an electrical connector assembly comprising a pair of mating connector subassemblies and in which a double ended shorting clip is first automatically disengaged at one end from its associated metal terminals in one of the connector subassemblies to break a first shorting path when the mating connector subassemblies are connected together and thereafter is automatically disconnected at its other end from the associated metal terminals to break a second shorting path by a connector position assurance member so that the second shorting path across the metal terminals cannot be disconnected unless proper mating of the connector subassemblies has been assured.

In the handling of electrically energizable charges or igniters, such as for cushion restraint systems for automotive vehicles, it is common practice to provide a short across the wires or leads connected to the charge or igniter prior to the usage thereof. The short eliminates the possibility of static electricity or RF interference from generating a current flow or voltage drop across the leads which could produce premature accidental actuation of the charge or igniter. It is also known to employ an electrical connector means comprising mating connector subassemblies in which one has a shorting means in the form of a spring clip which is self biased toward a position in which it engages its associated terminals to provide a bussing shunt across the terminals when the connector subassemblies are disconnected and in which the other connector subassembly includes a cam means which engages the spring biased shorting clip to automatically disengage the shorting clip from its associated terminals subsequent to the mating terminals of the connector subassemblies engaging one another. In this arrangement the respective terminals of the connector subassemblies are first engaged with each other prior to the cam means of the other connector subassembly disengaging the shorting means from its associated terminals of the one connector subassembly. Such an arrangement is shown in U.S. Pat. No. 3,869,191, which patent is assigned to the same assignee as the present invention.

In a copending patent application filed concurrently herewith in the names of Steven Felix, Randy Fink and Joseph Gladd, and assigned to the same assignee as the present invention, and designated by assignee's number G-11352, a new and improved electrical connector assembly of the above noted type was disclosed. In this application the shorting means carried by one of the connector subassemblies is in the form of a shorting spring clip which is self biased toward a position in which it engages its associated terminals so as to automatically provide for bussing across the terminals when the connector subassemblies are disconnected, and in which the connector assembly includes a connector position assurance member for assuring that the connector subassemblies have been properly mated together and in which the connector position assurance member also included a cam means thereon which engaged the shorting clip to automatically disengage the shorting clip from its associated terminals only if the connector subassemblies had been properly mated or connected together. This shorting arrangement insured that no premature actuation could occur, since the connector subassemblies had to be properly connected together and the connector position assurance member had to be properly connected before the shorting clip was disengaged. Also disclosed was a dual shorting arrangement in which a cam means on one of the connector subassemblies first disengaged one end of the shorting clip from its associated terminals and the cam means on the connector position assurance member disengaged the other end of the shorting clip from the terminals. This dual shorting arrangement provided further assurance against premature actuation of the cushion restraint system.

SUMMARY OF THE INVENTION

The present invention provides an improved electrical connector assembly of the type disclosed in the aforementioned assignee's copending patent application in that a third housing encircling the connector subassembly containing the shorting clip or clips is provided. The third housing functions to provide (1) environmental or splash protection for the connector subassembly, (2) strain relief for the conductor wires connected with the terminals, (3) a tethered connector position assurance member, (4) an integral terminal position assurance means for assuring that the terminals in the connector subassembly have all been properly connected in their insulator housing and (5) a deflectable dome overlying a pump handle latch member on the connector subassembly which can be depressed to release the latch member from the other connector subassembly only if the connector position assurance member is first disconnected from the third housing to insure that a short across the terminals has been reestablished prior to disconnection of the connector subassemblies.

The above features are achieved by designing the third housing in two halves, a floor half and cover half integrally connected to each other via a hinge. The cover can be pivoted from an open position in which it is disposed side-by-side with the floor and a closed position in which it overlies the floor and can be snap fittingly connected thereto. The third housing has an open forward end portion to slidably receive its associated connector subassembly, is snap fittingly connected to the connector subassembly and encircles the same to provide environmental splash protection. The third housing defines a pair of side openings therethrough when in the closed position. One of the side openings serves as a right angle passage for conductors connected to the terminals of the connector subassembly to provide strain relief for the conductors. The other opening houses a grooved retainer integrally connected via a tether to the connector position assurance member so that the latter is at all times retained on the third housing. The floor of the third housing has forwardly extending terminal position assurance members integral therewith and supported in cantilever fashion. These members are engageable with the terminals in the connector subassembly and assure that the terminals have all been properly connected.

The cover of the third housing has a channel and an opening therethrough adjacent its dome for slidably receiving the connector position assurance member. The latter is slidable under the pump handle latch member of the connector subassembly and snap fittingly connectable to the cover along has a cam means thereon for disengaging the shorting clip from its terminals if the two connector subassemblies have been properly connected. The connector position assurance member is engageable with the pump handle latch member if the connector subassemblies have not been properly connected. In the latter case, the cam means on the connector position assurance member cannot disengage the shorting clip from its terminals.

The connector position assurance member prevents the deflectable dome on the cover from depressing the pump handle if it is properly connected to the cover. It must first be removed from its connected position to enable the dome to be depressed to depress the pump handle. However, if the connector position assurance member is removed, shorting across the terminals is reestablished due to the cam means on the connector position assurance member having been disengaged from the shorting clip.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which:

DETAILED DESCRIPTION

Figure 1:
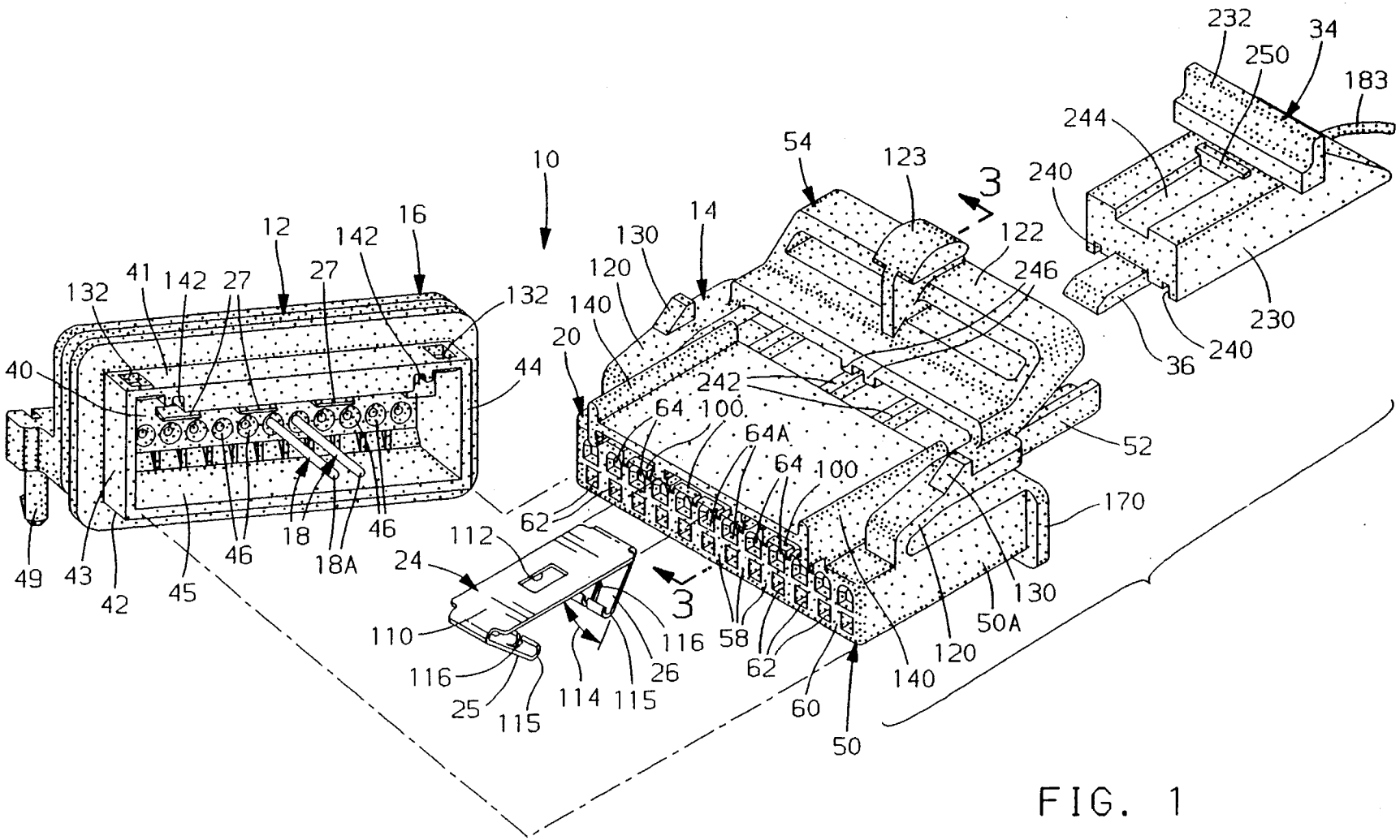
FIG. 1 is an exploded perspective view of some of the parts of the novel electrical connector assembly of the present invention.

Referring to the drawings, the novel electrical connector assembly 10 of the present invention comprises, in general, a pair of mating connector subassemblies 12 and 14. The connector subassembly 12 comprises a male insulator housing 16 which carries a plurality of laterally spaced, cylindrical, male pin terminals 18 therein. The connector subassembly 14 comprises a female insulator housing 20 for carrying a plurality of laterally spaced female socket terminals 22 therein (see FIG. 2). The female connector assembly 14 also carries a shorting clip 24 having pairs of spring fingers 25, 26 which are self biased towards a position in which they engage the adjacent female terminals 22 at spaced longitudinal locations to provide a pair of shorting paths thereacross when the connector assemblies 12, 14 are disconnected from one another. The male connector housing 16 has a cam means 27 which functions to engage the fingers 25 of the shorting clip 24 to disengage them from the female terminals 22 subsequent to the female terminals 22 engaging the male terminals 18 when the connector housings 16, 20 are connected together. The connector subassemblies 12, 14 are retained in their mated or engaged position, as shown in FIGS. 4 and 8, by a latching means 28.

Figure 6:
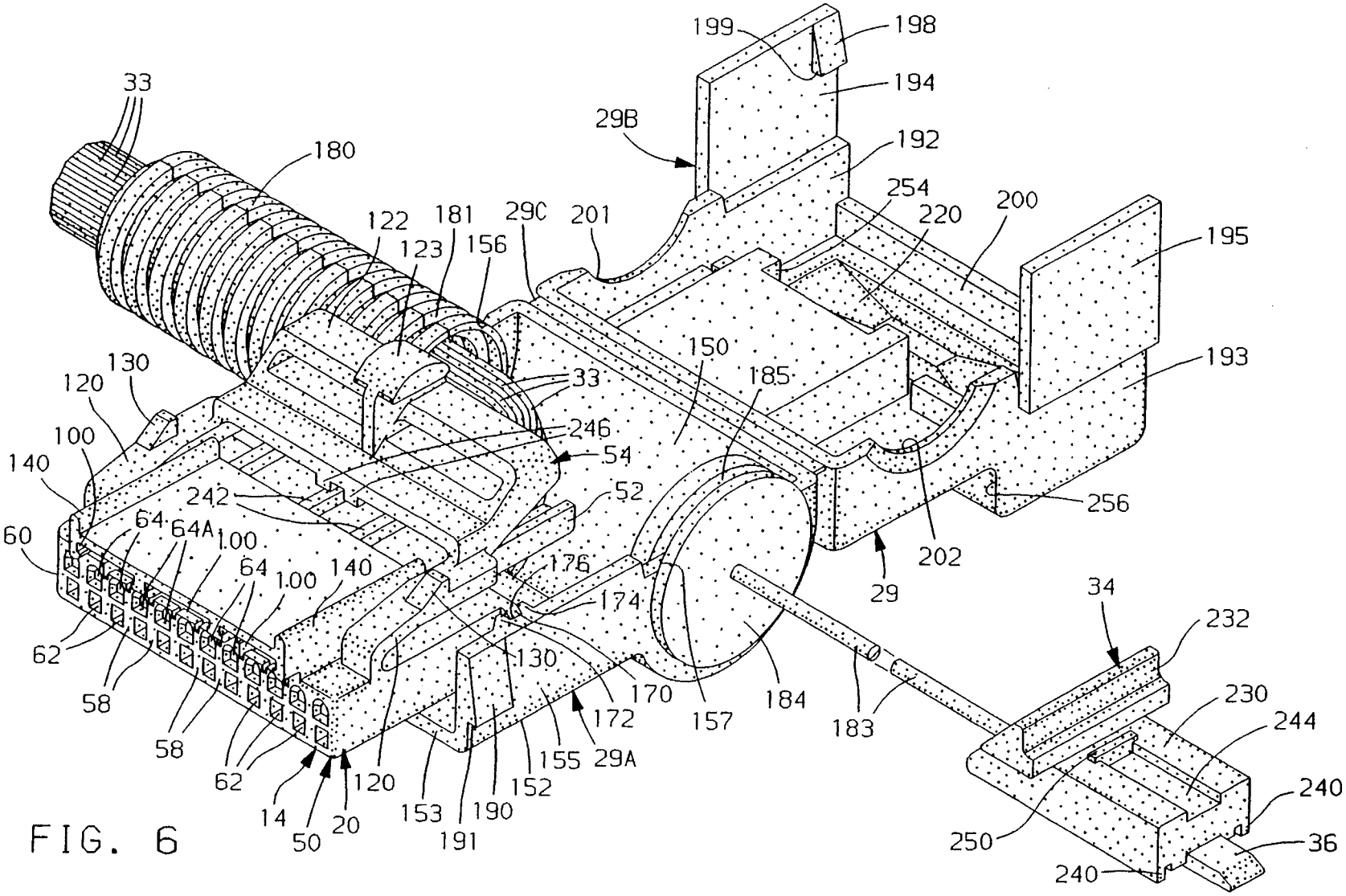
FIG. 6 is a perspective like that shown in FIG. 5, but showing additional parts of the electrical connector assembly of the present invention connected thereto.
Figure 7:
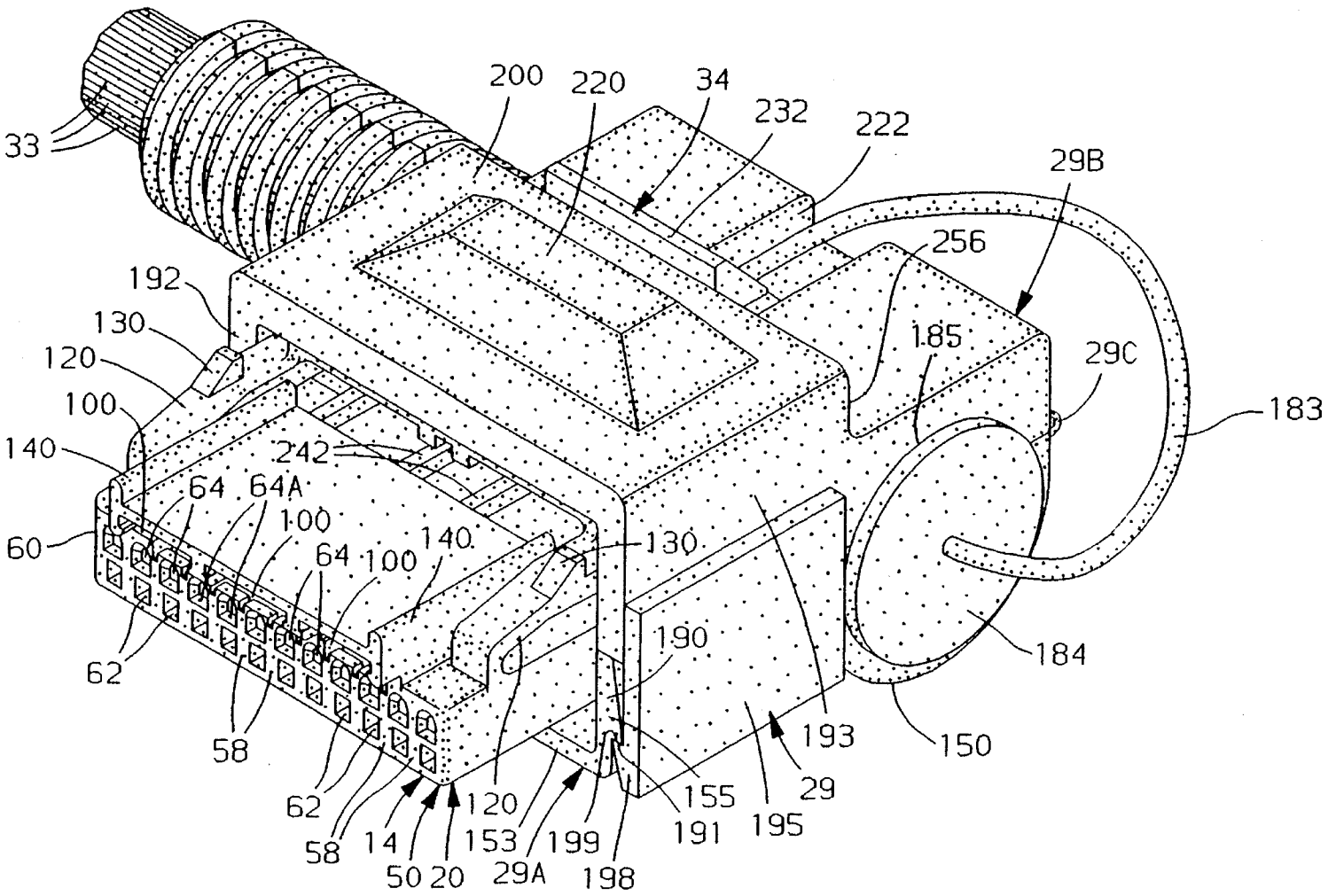
FIG. 7 is a perspective view of the parts shown in FIG. 6, but showing the same connected together.

The connector assembly 10 also includes a third housing 29 for encircling the connector subassembly 14 and part of the connector subassembly 12. The housing 29 comprises a floor half 29A and a cover 29B integrally connected via a hinge 29C. The connector subassembly 14 is snap fittingly connected to the floor 29A and the cover 29B is foldable about hinge 29C from its open position, as shown in FIG. 6 to a closed position, as shown in FIGS. 7 and 8, in which it is snap fittingly connected to the floor 29A. The floor 29A includes a terminal position assurance member (TPA) 30 which is slidably received by the female insulator housing 20 for assuring that the female terminals 22 are all properly seated or positioned within the insulator housing 20. The third housing 29 routes electrical conductors 33 connected to the terminals 22 through one of a pair of openings located at right angles to the terminals 22 to provide strain relief. The housing 29 further carries a tethered connector position assurance member (CPA) 34 for assuring that the connector subassemblies 12, 14 have been properly connected together. The connector position assurance member (CPA) 34 includes a cam means 36 which is engageable with the spring finger 26 of the shorting clip 24 to disengage the same from their associated adjacent female terminals 22 when it is locked to the cover 29B. The connector position assurance member 34 serves the dual purpose of assuring that the mating connector subassemblies 12, 14 have been properly connected together and for assuring that the shorting path or circuit across the terminals 22 cannot be broken unless the mating connector assemblies 12, 14 have been properly connected together.

The male insulator housing or body 16 of the connector subassembly 12 is made from a suitable dielectric material, preferably plastic, and is of a generally rectangular shape. The insulator housing 16 is in the form of a header housing having an end wall 40, a top wall 41, a bottom wall 42 and a pair of side walls 43, 44, which together define a central cavity 45. The end wall 40 has a plurality of laterally spaced through openings 46 for receiving the male pin terminals 18. The male pin terminals 18 (only two of which are shown in FIG. 1) are aligned in a row and have forward end portions 18A which project into the cavity 45 and have rearward end portions 18B which are bent at right angles to the forward portions 18A and which extend through openings 47 on a printed circuit board 48. The end portions 18B are adapted to be connected or soldered to printed circuit traces (not shown) on the printed circuit board 48. The male pin terminals 18 are retained within the end wall 40 of the insulator housing 16 via a press fit and in a manner conventional in the art. The male insulator housing 16 also includes a pair of barbed projections 49 integral with but located rearwardly of the end wall 40. The projections 49 are snap fittingly pushed through suitable openings (not shown) in the printed circuit board 48 to attach the insulator housing 16 to the printed circuit board 48. Alternately the housing 16 could have a pair of legs which could be bolted to the printed circuit board.

Figure 2:
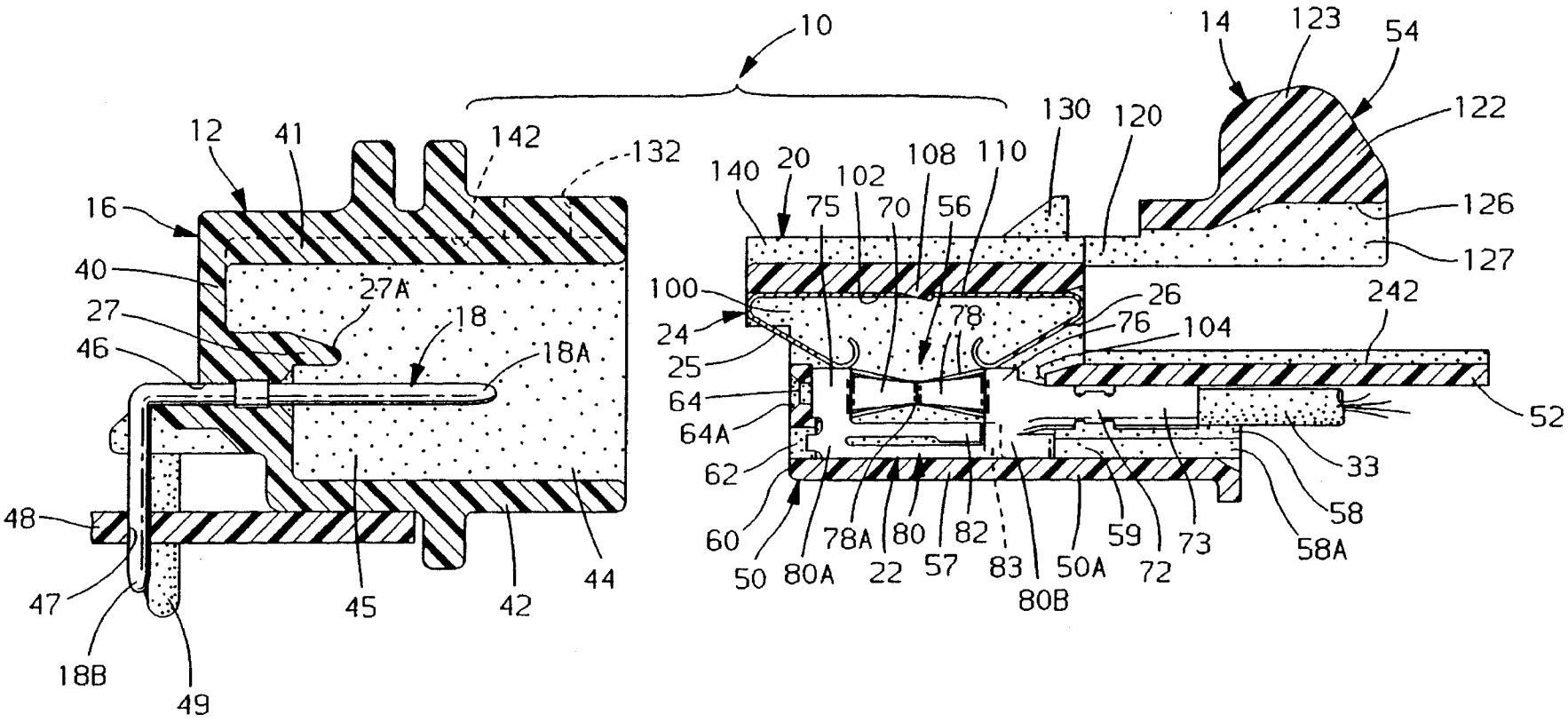
FIG. 2 is an enlarged axial cross sectional view of some of the parts of the novel electrical connector assembly shown in FIG. 1.
Figures 3, 4:
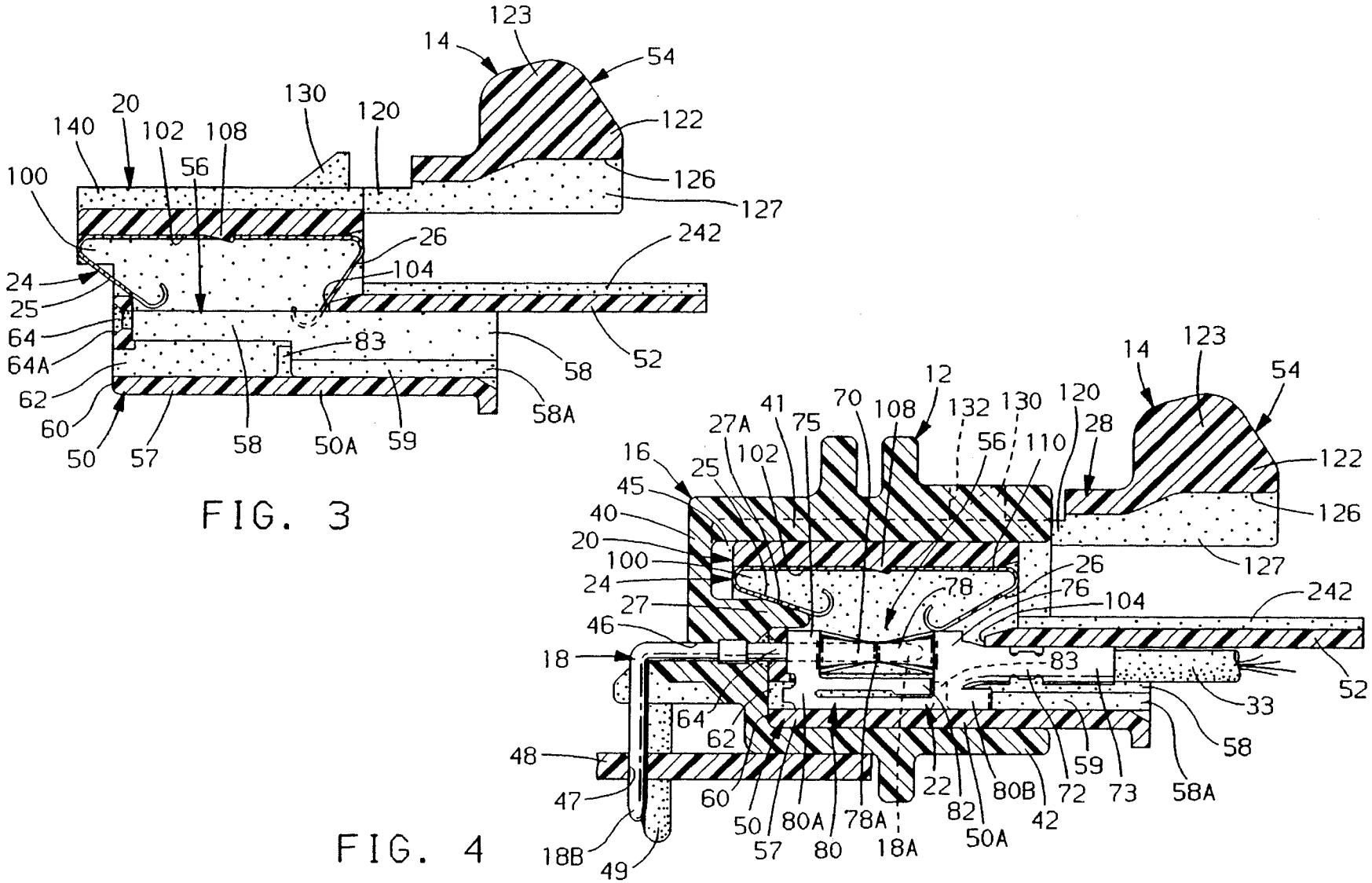
FIG. 3 is an enlarged axial cross sectional view taken approximately along line 3—3 of FIG. 1.
FIG. 4 is an enlarged axial cross sectional view like that shown in FIG. 2, but showing the parts connected together.
Figure 8:
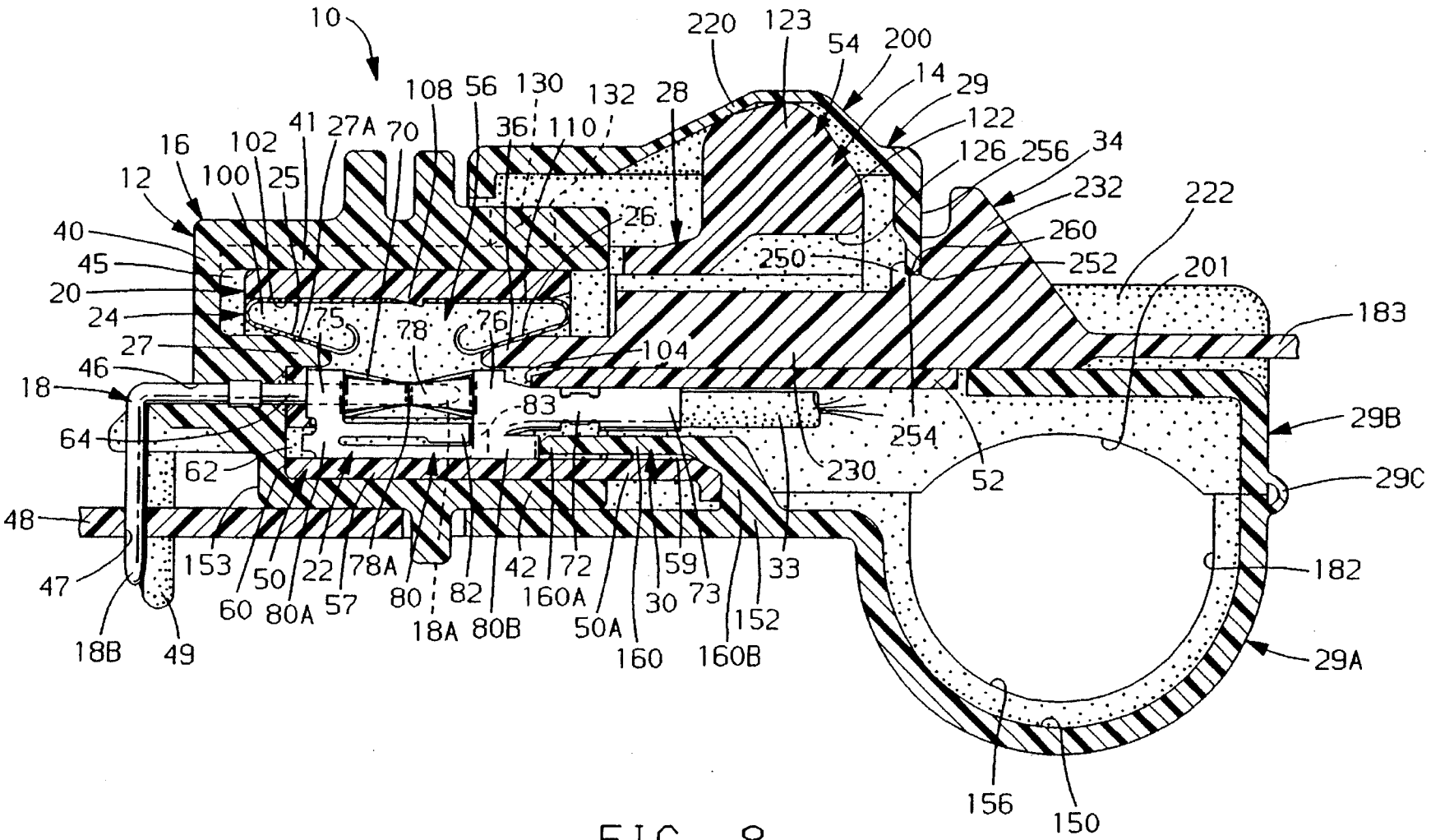
FIG. 8 is an enlarged axial cross sectional view of all of the parts of the electrical connector assembly of the present invention and showing the same connected together.

The male insulator housing 16 also includes the forwardly projecting cam means 27 in the form of three laterally spaced cams which are integral with the end wall 40 and project in a direction parallel to the forward portions 18A of the male pin terminals 18, the cams 27 extending within the cavity 45, as shown in FIGS. 4 and 8. The cams 27 also have a tapered upper surface, as indicated at 27A, to define a cam whose thickness progressively decreases from its end adjacent the end wall 40 towards its free end, as shown in FIG. 2.

The connector subassembly 14 comprises the insulated connector housing 20 which is made from a suitable dielectric material, such as plastic, and is of a generally rectangular shape complementary to that of the connector subassembly 12. The female connector housing 20 has a main or forward body portion 50, a rearward deck portion 52 and a pump handle latch member 54. The forward body portion 50 has a plurality of laterally spaced cavities or longitudinally extending openings 56 therethrough for receiving the female terminals 22. The cavities 56 have a planar bottom 57 and are separated from each other by vertically extending walls 58 and 58A which extend from a forward end wall 60 at the forward body portion 50 to the deck portion 52. The walls 58A are separator walls which divide the forward end portion 50 into three laterally spaced compartments. As best shown in FIG. 3, the other walls 58 along a rearward section 50A of the forward body portion 50 are spaced from the bottom 57 of the cavities 56 so that the cavities 56 in each compartment all communicate with a rectangularly shaped cavity 59 extending across each of the compartments in the forward body portion 50 of the housing 20 at their bottoms 57. The cavities 59 are adapted to slidably receive the terminal position assurance means 30, as will be hereinafter more fully described. The forward end wall 60 includes pairs of vertically spaced openings 62, 64 therein which are aligned with and in communication with the cavities 56. The openings 64 have a tapered entry end 64A.

The longitudinally extending cavities 56 are adapted to receive the female socket terminals 22. The female socket terminals 22 could be of any suitable or conventional construction, but are preferably of the type shown and described in U.S. Pat. No. 4,448,477, issued May 15, 1984, and assigned to the same assignee as the present invention. Since resort may be had to the aforementioned U.S. Pat. No. 4,448,477 for a complete description of the female socket terminals 22, the socket terminals 22 will only be herein described to the extent necessary for an understanding of the present invention.

The socket terminals 22 have an elongated resilient socket 70 at one end and a conductor attachment at its other end comprising conventional conductor core and insulation crimp barrels 72 and 73 for attachment to the core and insulation of the insulated electrical conductors 33. The socket 70 comprises a pair of axially spaced, split tubes 75, 76 which are joined by a circumferentially spaced array of juxtaposed spring strips 78. The split tubes 75, 76 are rectangular in shape and the circumferential array of juxtaposed spring strips 78 consists of four spring strips which are integral at each end with their respective sides of the rectangularly shaped split tubes 75, 76. The spring strips 78 taper inwardly from each end, as shown in FIG. 2, to provide contacts at their narrowest width 78A for biasingly engaging the cylindrical pin terminals 18 which are adapted to be inserted therein, and in a manner to be hereinafter more fully described. The socket terminal 22 further includes a retaining means comprising a U-shaped guard 80 and a resilient latch tang 82. The U-shaped guard has axially spaced legs 80A, 80B which are integral with the respective split tubes 75, 76 and the resilient latch tang 82 is integral with one end to the leg 80A of the U-shape guard 80 and extends generally axially of the elongated resilient socket 70.

The socket terminals 22 are connected to the insulator body 20 by inserting the same into the cavities 56 from right to left, as viewed in FIG. 2. The leg portions 80A and 80B of the U-shaped guard 80 slide along the bottom wall 57 of the cavities 56. The latch tang 82 is adapted to engage an abutment 83 integral with and extending transversely of the vertical wall 58 into the cavity 56 and be deflected until the female terminal 22 is moved all the way into engagement with the forward end wall 60 whereupon the latch tang 82 will return to its normal free state position and latch behind the abutment 83 to prevent reverse movement of the socket terminal 22. The socket terminal 22 engages the forward end wall 60 to prevent over-insertion of the same into the cavity 56. The reason for the provisions of the openings 62 is to allow a suitable tool to be inserted through the openings 62 to unlatch the latch tang 82 should a need arise for the terminal 22 to be replaced. Also in this position, the socket 70 of each socket terminal 22 is aligned with the upper opening 64 to receive a mating pin 18 when connected to the connector housing 12.

The insulator body 20 also houses the shorting clip 24 which is adapted to engage the axially split tubes 75, 76 of adjacent terminals 22 when the insulator body 20 is disconnected from the insulator body 16 of the connector subassembly 12. To this end, the insulator body 20 has three laterally spaced cavities 100 extending axially therethrough and which are located directly above the cavities 56 containing the female socket terminals 22. Although only one shorting clip 24 is shown in the drawings and described herein, up to three shorting clips 24 could be employed, one for each cavity 100. The cavities 100 have a planar upper inner wall surface 102 extending the full axial length of the main or forward body portion 50 and are in communication with and adjacent a pair of the cavities 56 located therebeneath via slots 104. The upper wall 102 of each of the cavities 100 also includes an integral downwardly extending tapered nib or protrusion 108 which extends laterally inwardly into the cavity 100.

As best shown in FIGS. 1 and 2, the shorting clip 24 is double ended and includes a planar main or bridge portion 110 having a central cut out 112. The shorting clip 24 also includes pairs of spring fingers 25, 26 which are integral with the bridge portion 110 at its opposite forward and rearward ends, or left and right ends, as viewed in the drawings. The fingers 25, 26 are reversely bent or curled underneath the bridge portion 110 and extend towards each other. The spring fingers 25, 26 form an acute included angle 114 with the bridge portion 110 and they have curled ends 115. The spring fingers 25, 26 of each pair are separated by slots 116 to provide a pair of laterally spaced fingers 25, 26, as best shown in FIG. 1. The slots 116 receive a common vertical wall 58 between the adjacent cavities 56 and allows the curled ends 115 of the spring fingers 25, 26 to extend downwardly into the adjacent cavities 56 to engage the axially split tubes 75, 76 of the female socket terminal 22 located therein. The spring fingers 25, 26 of each pair of spring fingers thus engages adjacent terminals 22 located in adjacent cavities 56 to provide a shunt or short across the adjacent terminals 22 when the subassembly 14 is disconnected from the subassembly 12.

The shorting clip 24 is connected to the female connector housing 20 by inserting the same from left to right, as viewed in FIGS. 2 or 4 of the drawings. When the shorting clip 24 is inserted into the cavity 100, the bridge portion 110 will engage the inwardly extending nib 108 and be deflected downwardly toward the female terminal 22. During this movement, first the spring fingers 26 and then the spring fingers 25 will engage the female terminal 22 and ride thereover. Engagement between the spring fingers 25, 26 and the female terminal 22 will cause a spring biasing force to be exerted against the bridge portion 110 as it is being slid over the nib 108. When the cut out 112 in the shorting clip 24 is aligned with the nib 108, the biasing force of the spring fingers 25, 26 will move the bridge portion 110 into engagement with the planar inner wall 102 of the insulator housing 20 and the shorting clip will be locked against reverse movement. When the shorting clip 24 is connected to the insulator housing 20, the curled ends 115 of each pair of spring fingers 25, 26 will engage the axially split tubes 75, 76 of adjacent female terminals 22 to provide a dual shunt or short across the adjacent pair of terminals 22 to prevent premature actuation of the restraint system.

The pump handle latch member 54 of the latching means 28 is integral with the connector housing 20 and includes a pair of spaced, rearwardly extending arms 120 and a transversely extending bridge or handle portion 122. The arms 120 are integrally formed at their forward ends to the main or forward body portion 50 of the housing 20 and extend upwardly and rearwardly of the housing 20 in cantilever fashion. The bridge portion 122 is integral with the arms 120 at their rearward ends, as viewed in FIG. 1. The bridge portion 122 has an upwardly extending headed protrusion 123 which can be manually engaged to depress the latch member 54 toward the housing 20 in opposition to its inherent, resilient self biasing force tending to bias the same to the position shown in FIG. 1, which is its normal free state position. The bridge portion 122 also extends upwardly at a slant, as shown in FIG. 1, and has an underside 126 which is spaced from the rear deck 52 of the insulator housing 20, and for reasons to be hereinafter more fully described. The bridge portion 122 also has a plurality of laterally spaced, longitudinally extending ribs 127 on its underside 126, and for a reason to be hereinafter more fully described.

The latch arms 120 also include an upwardly extending tapered latch 130 to enable it to be latched in a catch 132 in the connector housing 16. The catches 132 comprise a pair of laterally spaced openings in the upper wall 41 of the insulator housing 16. In addition, the insulator housing 20 includes a pair of laterally spaced, axially and upwardly extending ribs 140 which are adapted to be received within a pair of axially extending grooves 142 in the upper wall 41 of the connector housing 16 to guide the insulator housing 20 into the insulator housing 16 when being connected thereto and to prevent upside down or improper insertion of the connector housing 20 into the connector housing 16.

When the terminals 22 have all been assembled to the female insulator housing 20 and the shorting clips 24 have been inserted into the cavities 100 in the connector housing 20 and seated therein, the connector subassembly 14 can then be connected to the connector subassembly 12. This is accomplished by inserting the main or forward body portion 50 of the insulator housing 20 into the cavity 45 of the insulator housing 16. The insulator housing 20 can only be inserted if it is properly oriented relative to the insulator housing 16 due to the provision of the ribs 140 which have to be slidably received within the grooves 142 in the insulator housing 16. As the insulator housing 20 is slid into the insulator housing 16, the tapered latches 130 will engage the upper wall 41 of the insulator housing 16 and cause the arms 120 to be deflected downwardly until the latches 130 are aligned with the openings 132 in the housing 16 whereupon the latch member 54, due to its inherent resiliency, will return toward its normal free state position, and the latches 130 will be received within the openings 132 to lock the insulator housing 20 to the insulator housing 16. To disconnect the housing 20 from the housing 16, the latch member 54 can be depressed to disengage the latches 130 from the openings 132 and the housings 16, 20 then pulled apart.

Also, as the connector housings 16, 20 are being connected together, the pin terminals 18 will be guided via the tapered entry ends 64A through the openings 64 in the end wall 60 and be received in the socket terminals 22. The pin terminals 18 deflect outwardly the strips 78 of the terminals 22 and with the strips 78 biasingly engaging the pins 18 when the latter are received between the strips 78.

It should further be noted at this point that the insulator housing 16 includes the three laterally spaced cam members 27 which project inwardly into the cavity 45 from the bottom wall 40 thereof and which are aligned with the cavities 100 in the insulator housing 20. The cam members 27 are tapered, as indicated by reference numeral 27A, so as to have progressively decreasing thickness preceding from the wall 40 to their free ends. The purpose of each of the cam members 27 is that as the connector housing 20 is connected to the connector housing 16, it will engage beneath the ends 115 of any spring fingers 25 in its path and cause the spring fingers 25 to be deflected upwardly in opposition to their self biasing forces and be disengaged from the split tubes 75 of the adjacent terminals 22, as shown in FIG. 4. However, while the cams 27 disengage the spring fingers 25 from the split tubes 75, note that the spring fingers 26 still remain in engagement with the split tubes 76 of the terminals 22 to continue a short or shunt across adjacently located terminals 22.

The electrical connector assembly 10 also includes the third housing 29 which connects to and encircles the connector subassembly 14 to provide environmental or splash protection. The housing 29 is made from a suitable flexible plastic material. The housing 29 comprises two halves, a floor half 29A and a cover half 29B which are integrally hinged together via a hinge 29C. The floor 29A has a semicircular bottom portion 150 adjacent the hinge 29C and a planar bottom portion 152 adjacent its forward end 153. The floor also has a pair of vertical sides 154, 155. The sides 154,155 have aligned, semicircular openings 156, 157, and for a reason to be hereinafter more fully described.

Figure 5:
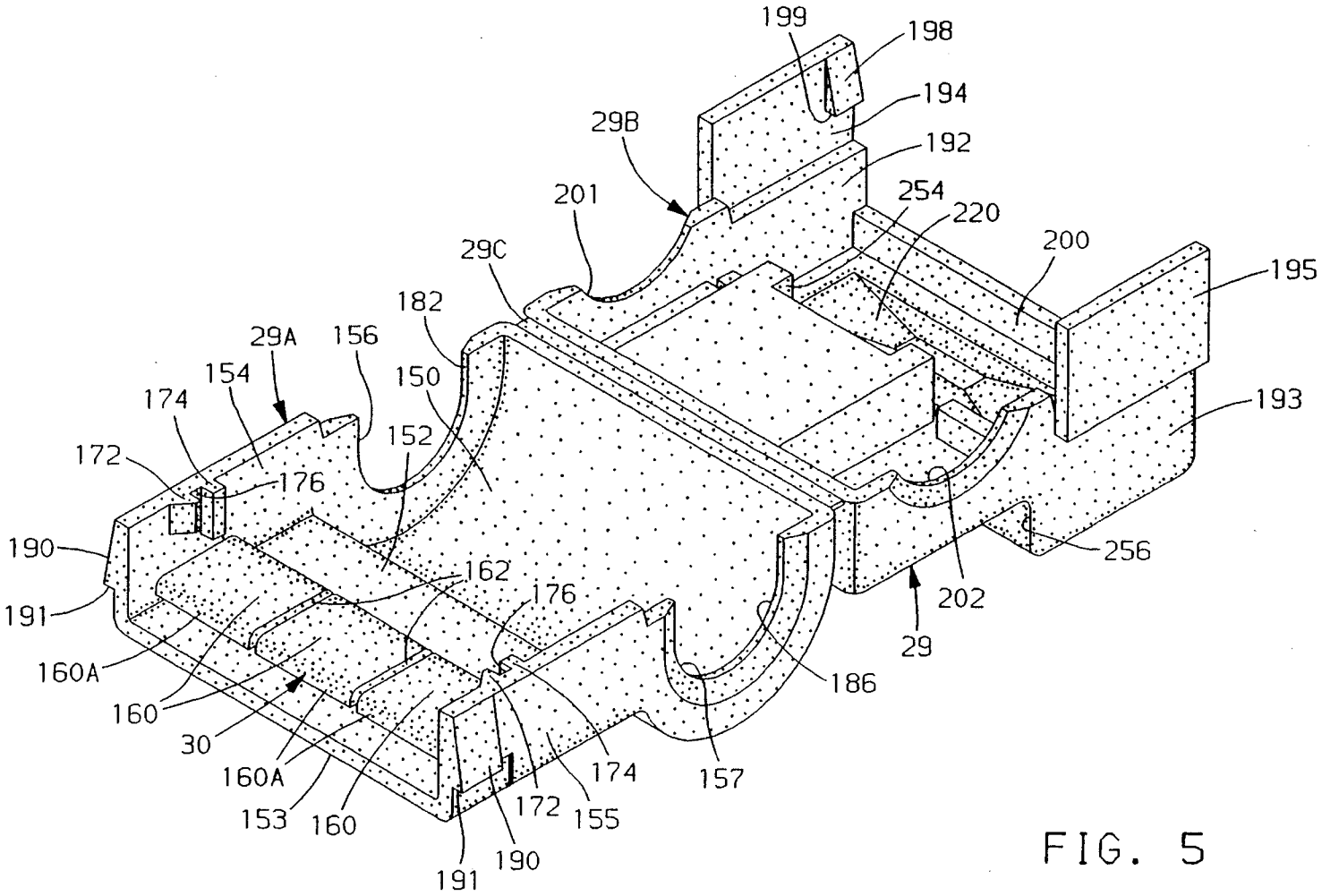
FIG. 5 is a perspective view of a third housing comprising part of the electrical connector assembly of the present invention and showing the same in its open position.

The planar bottom 152 of the floor 29A adjacent its forward end 153 supports the terminal position assurance means 30. As best shown in FIGS. 5 and 8, the terminal position assurance means 30 comprises three laterally spaced, forwardly extending arms 160. The arms 160 are integrally molded to the floor 152 and are supported by the floor 152 in cantilever fashion. The arms 160, as best shown in FIG. 8, have a forwardly extending portion 160A which is parallel to the planar floor 152 but spaced upwardly therefrom and a vertically extending wall 160B integral with the floor 152. The arms extend forwardly to a location spaced slightly inwardly from the forward end 153 the floor 29A. As best shown in FIG. 5, the arms 160 are separated by slots 162 which receive the walls 58A of the forward portion 50 of the housing 20.

The arms 160 are adapted to be slidably received within the common cavities 59 beneath the rearward section of the walls 58 of the insulator housing 20 when the insulator housing 20 is slidably connected to the floor 29A by sliding the same from left to right, as viewed in FIG. 8. The walls 58A are slidably received in the slots 162 during this movement. As best shown in FIG. 8, the bottom wall 57 of the insulator housing 20 is slidably received within the space between the cantilever arms 160 and the bottom 152 of the floor 29A. If all of the terminals 22 have been properly positioned within the insulator housing, the arms 160 will merely slide on the bottom 57 and be engageable with the rear end of the terminals 22, as shown in FIG. 8. Thus, the third housing 29 has the terminal position assurance means 30 integrally molded thereon and the connector assembly 10 does not require a separate terminal position assurance member.

The insulator housing 20 is adapted to be snap fittingly connected to the floor 29A of the third housing 29. To this end, the insulator housing 20 at the rear end of its sides defining the forward portion 50 has a pair of ears 170 extending laterally outwardly therefrom. The opposite sides 154, 155 of the floor 29A of the third housing 29 each have a pair of spaced, inwardly extending abutments 172, 174. The abutment 172 is a tapered ramp and defines with the abutment 174 a recess 176. The insulator housing 20 when being connected to the third housing 29 by sliding the insulator housing on the floor 152 has its ears 170 engage the tapered ramps 172. This causes the sides 154, 155 to be deflected outwardly until the ears are aligned with the grooves 176 whereupon the sides 154, 155, due to their inherent resiliency, will return to their normal free state position to capture the ears 170 and lock the connector housing 20 in place on the floor 29A. It should be noted that this locking engagement between the ears 170 and the abutments 172, 174 cannot occur if all of the terminals 22 have not been properly positioned within the insulator housing 20 since the terminal position assurance arms 160 would engage any such terminal and prevent the insulator housing 20 from being slidable on the floor 29A of the third housing 29. Thus, connecting the housing 20 to the third housing 29 also automatically positions the terminal position assurance means 30 in its operative position.

As best shown in FIG. 6, the conductors 33 which are connected to the terminals 22, pass underneath the rear deck 52 of the insulator housing 20 and are then bent at right angles. The conductors 33 extend through an axially slit, corrugated conduit 180, the conduit 180 in turn being secured to the side wall 154 by having one of its recesses 181 receiving an adjacent peripheral end 182 of the side wall 154 defining the opening 156. This bending of the wire conductors 33 and routing them through the side wall opening 156 provides a strain relief for the wire conductors 33. Alternately, the conductors could be routed through the other side wall opening 157 of the side wall 155.

In addition, the tethered connector position assurance member 34 is connected to the side wall 155 of the floor 29A, as best shown in FIG. 6. The connector position assurance member 34 is tethered to the third housing 29 via an integral, flexible plastic rope 183 and a cylindrical retainer 184 having a radially inwardly extending annular groove 185 which receives a peripheral end portion 186 of the side wall 155 defining the opening 157. The rope 183 tethers the connector position assurance member to the retainer 184.

When the insulator housing 20 has been connected to the floor 29A and the conduit 180 connected thereto and the cylindrical retainer 184 of the tethered connector position assurance member 34 has been connected thereto, the cover 29B can be moved about the hinge 29C from its open position, as shown in FIG. 6, to its closed position, as shown in FIG. 7, and cover the aforementioned parts. The cover 29B is adapted to be snap fittingly connected to the floor 29A. To this end, the floor 29A externally on its sides 154, 155 at the forward end 153 has a pair of ramped projections 190 extending outwardly therefrom which define downwardly facing abutments 191, as shown in FIGS. 6 and 7. The cover 29B has a pair of spaced vertical side walls 192, 193 including integral flaps 194, 195, respectively. The flaps 194, 195 have ramped inwardly extending projections 198 on their inner sides which define a transverse abutment surface 199 at their ramped ends.

When the cover 29B is moved from its open position, as shown in FIG. 6, to its closed position, as shown in FIG. 7, the ramps 194 will engage the ramps 190 and cause the flaps 194, 195 to be deflected outwardly until the ramps 198, 190 clear each other whereupon the flaps 194, 195, due to their inherent resiliency, will return to their normal free state position and lock the ramps 198 underneath the ramps 190, as shown in FIG. 7. In this position the abutments 191, 199 engage each other.

The cover 29B has a top 200 and the pair of side walls 192, 193 which are integral with the flaps 194, 195, respectively. The side walls 192, 193 also have semicircular openings 201, 202 therethrough which cooperate with the openings 156, 157 in the floor 29A to provide circular openings when the cover 29B is in its closed position. The side walls 192, 193 adjacent the periphery of the openings 201, 202 are respectively received within the groove 181 in the corrugated conduit 180 and the groove 185 in the cylindrical retainer 184 and function thereby to lock the corrugated conduit 180 and the cylindrical retainer 184 in place on the third housing 29. The top 200 of the cover 29B has a depressible and deflectable dome 220 which is thinner than the remainder of the cover 29B so as to be readily depressible and deflectable. The dome overlies the upwardly extending protrusion 123 of the bridge member 122 of the pump handle 54. The top 200 of the cover 29B also is formed to define a central rectangularly shaped channel 222 along its rearward portion for slidably receiving the connector position assurance member 34.

The connector position assurance member 34 is made of plastic and has a rectangular main body portion 230, a transversely extending, manually graspable handle portion 232 at its rear end a forwardly extending cam 36 projecting forwardly of its forward end along its underside. As best shown in FIG. 6, the body portion 230 along its underside also has a pair of laterally spaced grooves 240 which are adapted to receive a pair of laterally spaced rails 246 on the top side of the deck portion 52 of the insulator housing 20. The connector position assurance member 34 also has a longitudinally extending linear groove 244 on its top side which is adapted to receive a pair of closely spaced ribs 127 on the underside 126 of the bridge member 122 of the pump handle 54. The connector position assurance member 34 further includes an upwardly and transversely extending projection or nib 250 formed at the end of a linear groove 244 adjacent the handle portion 232 which is adapted to be snap fittingly connected to a beveled edge 252 on the dome 220 (see FIG. 8). The beveled edge defines part of a rectangular opening 254 located in a rear wall 256 of the top 200, the opening 254 being coextensive with and communicating the channel 222 in the top 200 of the cover 29B with the interior of the third housing 29, as shown in FIG. 8.

The connector position assurance member 34 is adapted to be slidably connected to the third housing 29 by sliding the same in the channel 222 in the top 200 of the cover 29B and through the opening 254. If the connector subassemblies 12, 14 have been properly connected together, the main body portion 230 of the connector position assurance member will slide underneath the pump handle 54 and its forward tapered cam 36 will engage the ends 26 of the shorting clip 24. Also during this movement, the grooves 240 will receive the rails 242 on the deck portion 52 and the groove 244 will receive the center ribs 127 on the underside of the pump handle 54.

This engagement between the cam 36 and the shorting clip 24 provides an important function in that it disengages the shorting path across the terminals 22. The connector position assurance member is locked to the cover 29B by the protrusion 250 thereon deflecting the beveled edge 252 on the rear wall 256 of the dome 220 until it moves therepast whereupon the rear wall 256 of the dome 220, due to its inherent resiliency, will return to its normal free state position and be received in a recess 260 between the beveled edge 252 and the handle portion 232 to lock the connector position assurance member 34 in place, as shown in FIG. 8. This connection is a snap fit connection.

It should be noted that if the connector subassemblies 12, 14 have not been properly connected together, the pump handle 54 will be deflected downwardly. In this position, the forward end of the connector position assurance member 34 will engage the laterally spaced ribs 127 on the pump handle 54 and thus be prevented from being connected to the cover 29B. Also, the cam 36 cannot unseat the ends 26 of the shorting clip 24 if this condition exists.

It should be apparent that the connector position assurance member 34 provides the dual function of assuring that the connector subassembly 14 has been properly connected or mated to the connector subassembly 12 so that the spring fingers 25 of the shorting clip are disengaged from their associated female socket terminals 22 and to provide the additional function of lifting spring fingers 26 from the same associated terminals 22 only if it can be latched to the cover of the third housing 29. This ensures that an accidental actuation of the restraint system cannot occur until the connector subassemblies 12, 14 are properly connected to each other and the connector position assurance member 34 has been properly connected to the third housing 29.

It should be further noted that the connector position assurance member 34 when connected to the cover, as shown in FIG. 8, prevents the dome 220 from being depressed to deflect the pump handle 54 downwardly and thus, prevents the connector subassemblies 12, 14 from being disconnected from each other. If it is desired that the connector subassemblies 12, 14 be disconnected from each other, it is necessary to first remove the connector position assurance member 34 from its engagement with the cover 29B by forcing the same rightward, as viewed in FIG. 8, to disconnect the protrusion 250 from the beveled edge 252 and slide the connector position assurance member 34 to the right. When this is done, however, the cam 36 releases the spring fingers 26 of the shorting clip and reestablishes a shorting arrangement across the associated terminals 22.

With the connector position assurance member 34 disengaged from the cover 29B, the dome 220 can be depressed to depress the pump handle 54 to enable the third housing 29 and the insulator housing 20 to be slidably removed from the insulator housing 16. This removal will also cause the ends 25 of the shorting clip 24 to reengage their associated terminals 22 because the shorting clip 24 will be disengaged from the cams 27.

From the foregoing, it should be apparent that the third housing 29 and the connector position assurance member 34 encircle the connector subassemblies 12, 14 a sufficient extent to provide environmental or splash protection for the connector subassemblies 12, 14. The third housing also provides strain relief for the conductor wires 33 connected with the terminals 22, and carries a tethered connector position assurance member 34 via a rope 183 and integral retainer 184 connected to the housing 29. The third housing 29 also has an integral terminal position assurance means 30 for assuring that the terminals 22 in the connector subassembly 14 have all been properly connected in their insulator housing 20 and it has a deflectable dome 220 overlying a pump handle latch member 54 on the connector subassembly 14 which can be depressed to release the latch member 54 from the other connector subassembly 12 only if the connector position assurance member 34 is first disconnected from the third housing 29 to ensure that a short across the terminals 22 has been reestablished prior to disconnection of the connector subassemblies 12, 14.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. An electrical connector assembly comprising:

a first insulator housing having a plurality of first spaced apart cavities therein, a first plurality of metal terminals housed in said first cavities, a second cavity in said first insulator housing which is laterally spaced from said first cavities, said first insulator housing having a slot for communicating said first and second cavities, a spring clip housed within said second cavity, said spring clip having a bridge portion extending transversely of the second cavity and a plurality of spaced resilient fingers extending transversely of the bridge portion through the slot means and overlying respective ones of the first terminals, said fingers each having an end portion which is engaged with one of the first plurality of terminals to provide a shorting path between the respective ones of said first plurality of terminals, said spring clip when disposed in the second cavity being self-biased toward a position in which the end portions of the fingers engage the respective ones of the first plurality of terminals, a second insulator housing which is matable with the first insulator housing, said second insulator housing having a plurality of spaced openings therein, a second plurality of metal terminals carried by said second insulator housing and extending through said openings of said second insulator housing which are adapted to mate with the first plurality of terminals in the first insulator housing when the second insulator housing is mated to the first insulator housing, a latch means on said first and second insulator housings to latch said first and second insulator housings together when they are fully mated to each other, a third housing comprising a floor half and a cover half integrally hinged together for movement between an open side by side position and a closed position in which said cover overlies the floor and as connected thereto, said first insulator housing being slidably and blockably connected to said floor when the third housing is in its open position, said cover having a channel and an opening through a back wall thereof for slidably receiving a connector position assurance member, a connector position assurance member guided for linear sliding movement in the channel and on said first insulator housing and being lockable to the cover insulator housing if the first and second insulator housings and their respective terminals have been properly mated together, said connector position assurance member upon being slid being engageable with the first insulator housing and not lockable to the cover if the first and second insulator housings are not properly mated, wherein said connector position assurance cover member includes a first lock component and said insulator housing includes a second lock component matable with said first lock component and cam means on said connector position assurance member for engaging said fingers of said spring clip and moving said fingers out of engagement with said first plurality of metal terminals to interrupt said shorting path when being lockably connected to said cover whereby said connector position assurance member functions both to assure that the first and second insulator housings and their respective terminals have been properly mated and to prevent disengagement of the spring clip from said first plurality of terminals until the connector position assurance member has assured that the first and second insulator housings have been properly connected together.

2. An electrical connector assembly comprising:

a first insulator housing having a plurality of first spaced apart cavities therein, a first plurality of metal terminals housed in said first cavities, a second cavity in said first insulator housing which is laterally spaced from said first cavities, said first insulator housing having a slot for communicating said first and second cavities, a spring clip housed within said second cavity, said spring clip having a bridge portion extending transversely of the second cavity and a plurality of spaced resilient fingers extending transversely of the bridge portion through the slot means and overlying respective ones of the first terminals, said fingers each having an end portion which is engaged with one of the first plurality of terminals to provide a shorting path between the respective ones of said first plurality of terminals, said spring clip when disposed in the second cavity being self-biased toward a position in which the end portions of the fingers engage the respective ones of the first plurality of terminals, a second insulator housing which is matable with the first insulator housing, said second insulator housing having a plurality of spaced openings therein, a second plurality of metal terminals carried by said second insulator housing and extending through said openings of said second insulator housing which are adapted to mate with the first plurality of terminals in the first insulator housing when the second insulator housing is mated to the first insulator housing, a latch means on said first and second insulator housings to latch said first and second insulator housings together when they are fully mated to each other, said latch means including a deflectable pump handle latch member on said first insulator housing which is deflectable to allow latches on the latch member to lock into openings in the second insulator housing when the housings are mated together, a third housing comprising a floor half and a cover half integrally hinged together for movement between an open side by side position and a closed position in which said cover overlies the floor and is connected thereto, said first insulator housing being slidably and lockably connected to said floor and said cover having a raised deflectable dome overlying said pump handle latch member and a channel and an opening through a back wall of the dome, a connector position assurance member guided for linear sliding movement in the channel of said cover and on said first insulator housing beneath said pump handle and being lockable to the cover if the first and second insulator housings and their respective terminals have been properly mated together, said connector position assurance member upon being slid being engageable with the pump handle of said first insulator housing and not lockable to the cover if the first and second insulator housings are not properly mated, said connector position assurance member preventing said deflectable dome on said cover from depressing the pump handle when connected to the cover, wherein said connector position assurance cover member includes a first lock component and said insulator housing includes a second lock component matable with said first lock component and cam means on said connector position assurance member for engaging said fingers of said spring clip and moving said fingers out of engagement with said first plurality of metal terminals to interrupt said shorting path when being lockably connected to said cover whereby said connector position assurance member functions both to assure that the first and second insulator housings and their respective terminals have been properly mated and to prevent disengagement of the spring clip from said first plurality of terminals until the connector position assurance member has assured that the first and second insulator housings have been properly connected together, said first insulator housing being disconnectable from said second insulator housing after being mated thereto only by first disconnecting said connector position assurance member from said cover and said shorting clip and thereafter depressing said deflectable dome on said cover to depress and unlatch said pump handle.

3. An electrical connector assembly as defined in claim 2 and wherein said floor and said cover adjacent said hinge means of said third housing have aligned semicircular openings through their sides which together define circular openings in the sides of the third housing when the housing is in its closed position, wherein said first terminals are connected to conductors which extend into said first cavities of said first insulator body, said conductors being bent at right angles and extending through one of the side openings of said third housing wherein the third housing provides a strain relief.

4. An electrical connector assembly, as defined in claim 3, and wherein said connector position assurance member is connected via a tether to said third housing.

5. An electrical connector assembly, as defined in claim 4, and wherein said tether at an end remote from the connector position assurance member has a circularly shaped retainer provided with a radial groove which receives side portions surrounding the semicircular openings in the third housing to lock the connector position assurance member to the third housing.

6. An electrical connector assembly as defined in claims 1 or 2 and wherein said floor of said third housing has a terminal position assurance means engageable with said first terminals of said first insulator housing when the third housing and the first insulator housing are connected together to assure that the first terminals have all been properly connected to said first insulator housing.

7. An electrical connector assembly as defined in claim 6 and wherein said terminal position assurance means comprises forwardly extending cantilever supported members and wherein the first insulator housing has a bottom wall slidably received between said cantilever supported members of said terminal position assurance means and the floor of the third housing.

8. An electrical connector assembly as defined in claim 5 and wherein said floor of said third housing has a terminal position assurance means engageable with said first terminals of said first insulator housing when the third housing and the first insulator housing are connected together to assure that the first terminals have all been properly connected to said first insulator housing.

9. An electrical connector assembly comprising:

a first insulator housing having a plurality of first spaced apart cavities therein, a first plurality of metal terminals housed in said first cavities, a second cavity in said first insulator housing which is laterally spaced from said first cavities, said insulator housing having slots through a wall common with said first and second cavities for communicating said second cavity with said first cavities, a shorting spring clip housed within said second cavity, said shorting spring clip having a flat bridge portion extending transversely of the second cavity and a pair of spaced, resilient fingers at opposite ends of the bridge portion which extend transversely from the bridge portion through said slots and overlie respective ones of the first terminals, each pair of said fingers engaging said respective ones of said first plurality of terminals to provide a double shorting path between said respective ones of said first plurality of terminals to provide a double shorting path between said respective ones of said first plurality of terminals, each pair of said fingers of said shorting spring clip when disposed in the second cavity being self-biased toward a position in which their end portions engage said respective ones of said first plurality of terminals, a second insulator housing which is matable with the first insulator housing, said second insulator housing having a plurality of spaced openings therein, a second plurality of metal terminals carried by said second insulator housing and extending through said openings in said second insulator housing which are adapted to mate with the first plurality of terminals in the first insulator housing, said second insulator housing having a cam means intermediate its ends, said insulator housings when being connected together causing said first and second plurality of terminals to matingly engage each other and then causing said cam means on said second insulator housing to engage one pair of the spring fingers at one end of the shorting spring clip to move said one pair of spring fingers in opposition to their self-biasing forces to disengage said one pair of spring fingers of the shorting spring clip from the respective ones of first plurality of terminals, cooperable means on said first and second insulator housings to latch said first and second insulator housings together when they are fully mated to each other, said cooperable means including a deflectable pump handle latch member on said first insulator housing which is deflectable to allow latches on the latch member to lock into openings in the second insulator housing when the housings are mated together, a third housing comprising a floor half and a cover half integrally hinged together for movement between an open side by side position and a closed position in which the cover overlies the floor and is connected thereto, said first insulator housing being slidably and lockably connected to said floor and said cover having a raised deflectable dome overlying said pump handle latch member and a channel and an openings through a back wall of the dome for receiving a connector position assurance member, said connector position assurance member being slidably in said channel on said first insulator housing and said cover being connectable to said cover of said third housing if the two insulator housings are properly mated together, said connector position assurance member engaging said pump handle on said latch member of said first insulator housing and not being connectable thereto if said first and second insulator housings are not properly mated, said connector position assurance member preventing said deflectable dome on said cover from depressing the pump handle when connected to the cover, said connector position assurance member having a second cam means for engaging the other pair of said spring fingers of the shorting spring clip to move said other pair of spring fingers in opposition to their self-biasing forces to disengage the other pair of spring fingers of the shorting spring clip from the first plurality of terminals whereby the connector position assurance member functions both to assure that the first and second insulator bodies and their respective terminals have been properly mated and to prevent disengagement of the other pair of fingers of the shorting spring clip from said respective ones of said first plurality of terminals until the connector position assurance member has assured that the first and second insulator housings have been properly connected together.

10. An electrical connector assembly as defined in claim 9 and wherein said floor of said third housing has a terminal position assurance means engageable with said first terminals of said first insulator housing when the third housing and the first insulator housing are connected together to assure that the first terminals have all been properly connected to said first insulator housing.

11. An electrical connector assembly comprising:

a female insulator connector housing, a male insulator connector housing, a shorting spring clip and a connector position assurance member;

said female connector housing having a planar bottom wall, a front end wall, two side walls, and an inner wall each vertically extending from the bottom wall; and a forward body portion extending in a rearward direction from the front end wall, said front end wall having a plurality of first and second laterally spaced apart openings, each opening for receiving a male terminal, and a slot overlying and traversing said first and second openings and constructed and arranged to receive said shorting spring clip therethrough into a third cavity, said bottom and inner walls defining first and second laterally spaced apart cavities, each of said first and second cavities having a metal female terminal received therein and communicating with a respective opening in the front end wall, each of said female terminals having first and second ends, said third cavity being defined by said front end wall and said forward body portion and being above said first and second cavities;

said spring clip having a bridge portion and first and second spaced apart fingers downwardly extending from one end of the bridge and third and fourth spaced apart fingers downwardly extending from the other end of the bridge, said spring clip being received in said third cavity so that said first and second fingers each are biased downward toward the first end of a respective female terminal and for engagement therewith in a first portion, and said third and fourth fingers each being biased downward toward the second end of a respective female terminal and engagement therewith in a first position;

said male insulator connector housing having first and second holes formed therein and first and second male terminals extending respectively through said first and second holes; said male terminals positioned to be received in said female terminals carried in the female housing, said male and female housings each having a latch element constructed and arranged to latch the housings together when they are fully mated to each other;

a third housing comprising a floor, a cover and a hinge for connecting the floor and cover together for movement between an open position and a closed position in which said cover overlies said floor and is locked to said floor;

said female insulator connector housing being slidable on said floor when the third housing is in its open position, said cover having a channel and an opening through a back wall thereof for slidably receiving a connector position assurance member;

a connector position assurance member guided for linear sliding movement in the channel and on said female insulator connector housing and being lockable to the cover if the male and female insulator connector housings and their respective terminals have been properly mated together, said connector position assurance member upon being slid being engageable with the female insulator connector housing and not lockable to the cover if the male and female insulator connector housings are not properly mated, and a cam on said connector position assurance member for engaging said fingers of said spring clip and moving said first and second fingers to a second position out of engagement with said metal female terminals to interrupt said shorting path when said connector position assurance member being lockably connected to said cover whereby said connector position assurance member functions both to assure that the male and female insulator connector housings and their respective terminals have been properly mated and to prevent disengagement of the spring clip from said first plurality of terminals until the connector position assurance member has assured that the male and female insulator connector housings have been properly connected together.

12. An electrical connector assembly as set forth in claim 11 further comprising a cam on said male connector housing constructed and arranged to extend through said slot formed in said front wall and to engage said third and fourth fingers and moving said third and fourth fingers to a second position out of engagement with said female terminals.

13. An electrical connector assembly as in claim 11 wherein said female connector housing has an elongated gap underneath said rear end of the forward body portion constructed and arranged so that said rear end is sufficiently deflectable to selectively unlatch said latch elements on said male and female connector housings.

14. An electrical connector assembly as set forth in claim 1 wherein an under face of the forward body portion has a nub formed thereon and said spring clip has a hole formed therein sufficient to frictionally receive said nub and secured said spring clip to said forward body portion in said third cavity.

15. An electrical connector assembly as set forth in claim 11 further comprising a deflectable pump handle latch member on said female insulator connector housing which is deflectable to allow the deflectable pump handle latch member to lock into an opening in the male insulator connector housing when said male and female connector housings are mated together.

16. An electrical connector assembly as set forth in claim 15 wherein said third housing further comprises a raised deflectable dome formed on said cover and overlying said pump handle latch member, and said third housing defining a channel along a rearward portion of the third housing and wherein the connector position assurance member is guided for linear sliding movement in said channel and on the female insulator connector housing beneath said pump handle latch member and being lockable to the cover if the male and female insulator housings and their respective terminals have been properly mated together, said connector position assurance member upon being slid being engageable with the pump handle of said female insulator housing and not lockable to the cover if the male and female insulator housings are not properly mated, said connector position assurance member preventing said deflectable dome on said cover from depressing the pump handle when connected to the cover; and said female insulator housing being disconnectable from said male insulator housing after being mated thereto only by first disconnecting said connector position assurance member from said cover and said shorting clip and thereafter depressing said deflectable dome on said cover to depress and unlatch said pump handle.

17. An electrical connector assembly as defined in claim 16 and wherein said floor and said cover adjacent said hinge of said third housing have aligned semicircular openings through their sides which together define circular openings in the sides of the third housing when the housing is in its closed position, wherein said female terminals are connected to conductors which extend respectively into said first and second cavities of said female insulator body, said conductors being bent at right angles and extending through one of the side openings of said third housing wherein the third housing provides a strain relief.

18. An electrical connector assembly, as defined in claim 16, and wherein said connector position assurance member is connected via a tether to said third housing.

19. An electrical connector assembly, as defined in claim 18, and wherein said tether at its end remote from the connector position assurance member has a circularly shaped retainer provided with a radial groove which receives side portions surrounding the semicircular openings in the third housing to lock the tethered connector position assurance member to the third housing.

20. An electrical connector assembly as defined in claims 15 or 16 and wherein said floor of said third housing has a terminal position assurance member engageable with said female terminals of said female insulator housing when the third housing and the female insulator housing are connected together to assure that the female metal terminals have all been properly connected to said first insulator housing.

21. An electrical connector assembly as defined in claim 20 and wherein said terminal position assurance member comprises forwardly extending cantilever supported members and wherein the female insulator housing has a bottom wall slidably received between said cantilever supported members of said terminal position assurance member and the floor of the third housing.

22. An electrical connector assembly as defined in claim 19 and wherein said floor of said third housing has a terminal position assurance member engageable with said female terminals of said female insulator housing when the third housing and the first insulator housing are connected together to assure that the female terminals have all been properly connected to said female insulator housing.

* * * * *